US005181876A

United States Patent [19]

Chen et al.

[11] Patent Number: 5,181,876

[45] Date of Patent: Jan. 26, 1993

[54] FLYING DISK AND TOP

[76] Inventors: Ching-Ming Chen, No. 8, Lane 14, Sec. 2, Tung-Kuang Rd.; Cheng-Fu Lee, No. 58, Alley 61, Sec. 1, Ta-Cheng Rd., both of Tainan City, Taiwan

[21] Appl. No.: 845,235

[22] Filed: Mar. 3, 1992

[51] Int. Cl.[5] ..... A63H 27/00; A63H 1/00

[52] U.S. Cl. ..... 446/47; 446/46; 446/256

[58] Field of Search ..... 446/46, 47, 240, 256, 446/264; 273/424, 428

[56] References Cited

U.S. PATENT DOCUMENTS

| | | | |
|---|---|---|---|
| 4,171,704 | 10/1979 | Sarkis | 446/46 X |
| 4,248,010 | 2/1981 | Fox | 446/47 |
| 4,253,269 | 3/1981 | Sullivan | 446/46 |
| 5,067,923 | 11/1991 | De Bourbon | 446/236 |

*Primary Examiner*—Mickey Yu
*Attorney, Agent, or Firm*—Baker & Daniels

[57] ABSTRACT

A flying disk includes a circular plate and a bowl-shaped member attached to the circular plate. The bowl-shaped member includes a threaded recess extending into the same. A threaded rod is threadably inserted into the threaded recess. A threaded rod has a tapered end so that the whole assembly serves as a top as well as a flying disk.

1 Claim, 4 Drawing Sheets

FLYING DISK AND TOP

BACKGROUND OF THE INVENTION

1. Field of Invention

The invention relates to a flying disk, more particularly to an improvement relating to a flying disk such that said flying disk can be employed in various ways, for instance as a top and the like.

2. Description of the Related Art

A flying disk is a well known toy much engaged by children, and people playing with a flying disk are a common sight in a playground. Some amusing electronic devices have been added to make them more aesthetic, such as providing a circuit board and providing a plurality of illuminating units and electrically connected to the circuit board on a flying disk so that the flying disk will give out multi-color lights in flight.

FIG. 1 shows an exploded view of a flying disk with an electronic device. As illustrated, the flying disk includes a circular plastic plate (1) having an annular flange (11) extending therefrom and a circuit board (12) with an eccentric switch (13) provided on a lower surface of the circular plate, and a plurality of illuminating units (14) are provided on an upper surface of the circular plate and are electrically connected to the circuit board (12). A housing (15) is provided on the circuit board (12) covering the same. Such a flying disk will give out lights during flight.

Referring to FIG. 2, the flying disk (11) is shown to be rotated on a finger tip. As will be easily understandable from the illustration, it is difficult to balance the plate on the finger tip since there is no other means of retaining the plastic on the finger tip.

SUMMARY OF THE INVENTION

It is a main object of the present invention to provide an improved flying disk having a differing configuration when compared to a conventional flying disk so that such an improved flying disk can be employed in various games, for instances as a top and the like.

According to the present invention, the flying disk includes a circular plastic plate having an upper surface, a lower surface and an annular flange extending therefrom, a circuit board being provided on said lower surface and a plurality of illuminating units being provided on said upper surface of said circular plate and electrically connected to the circuit board, and a bowl-shaped member being attached to said lower surface of the circular plate encapsulating the circuit board. The bowl-shaped member has a vertical height with respect to the circular plate which is less than the vertical height of the annular flange with respect to the circular plate. The bowl-shaped member includes a lower portion with a threaded recess extending therein. A short rod has a tapered end and another end of the short rod is threaded into the threaded recess wherein the tapered end has a length longer than the vertical length of the annular flange when the short rod is threaded into the recess.

BRIEF DESCRIPTION OF THE DRAWINGS

Other features and advantages of the present invention will become more apparent in the following detailed description, including drawings, all of which show a non-limiting form of the present invention, and of which.

DETAILED DESCRIPTION OF THE PREFERRED EMBODIMENT

Figure 1:
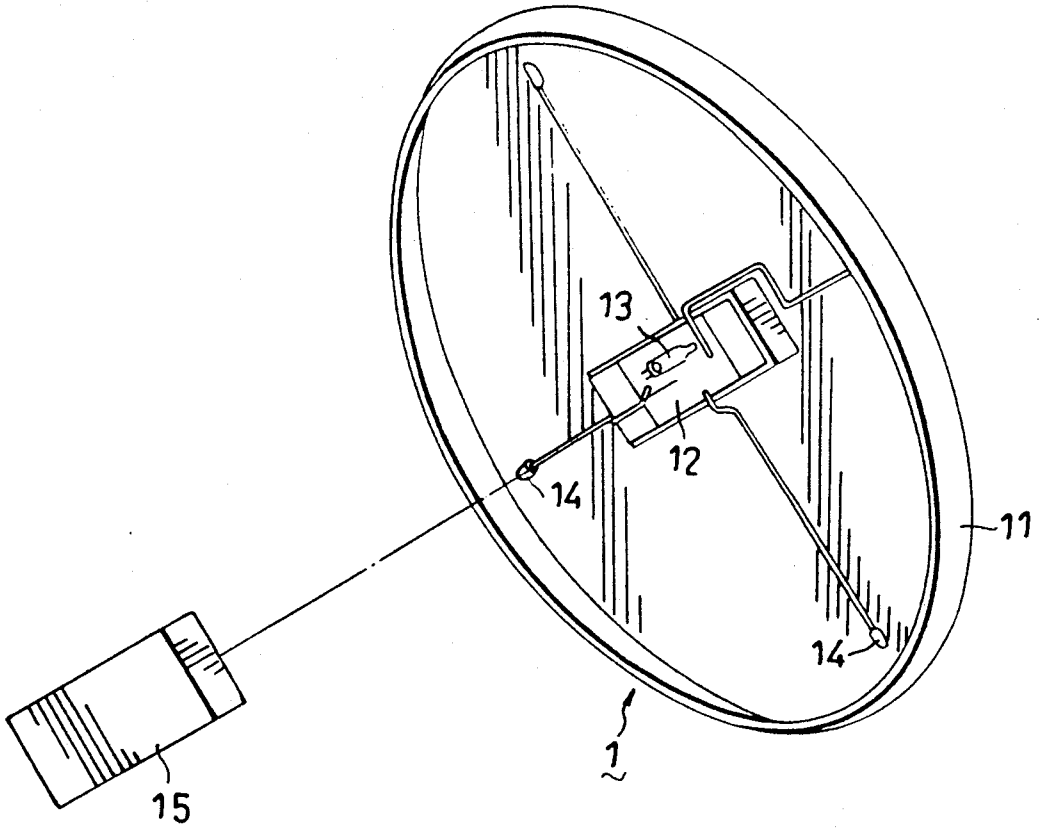
FIG. 1 PRIOR ART
FIG. 1 shows an exploded view of a conventional flying disk.
Figure 2:
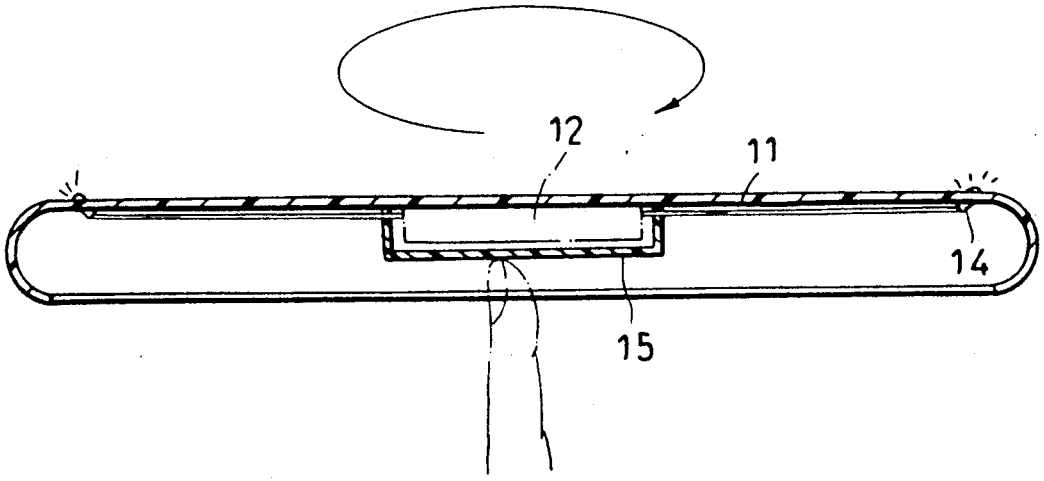
FIG. 2 PRIOR ART
FIG. 2 shows a side view of the conventional flying disk of FIG. 1.
Figure 3:
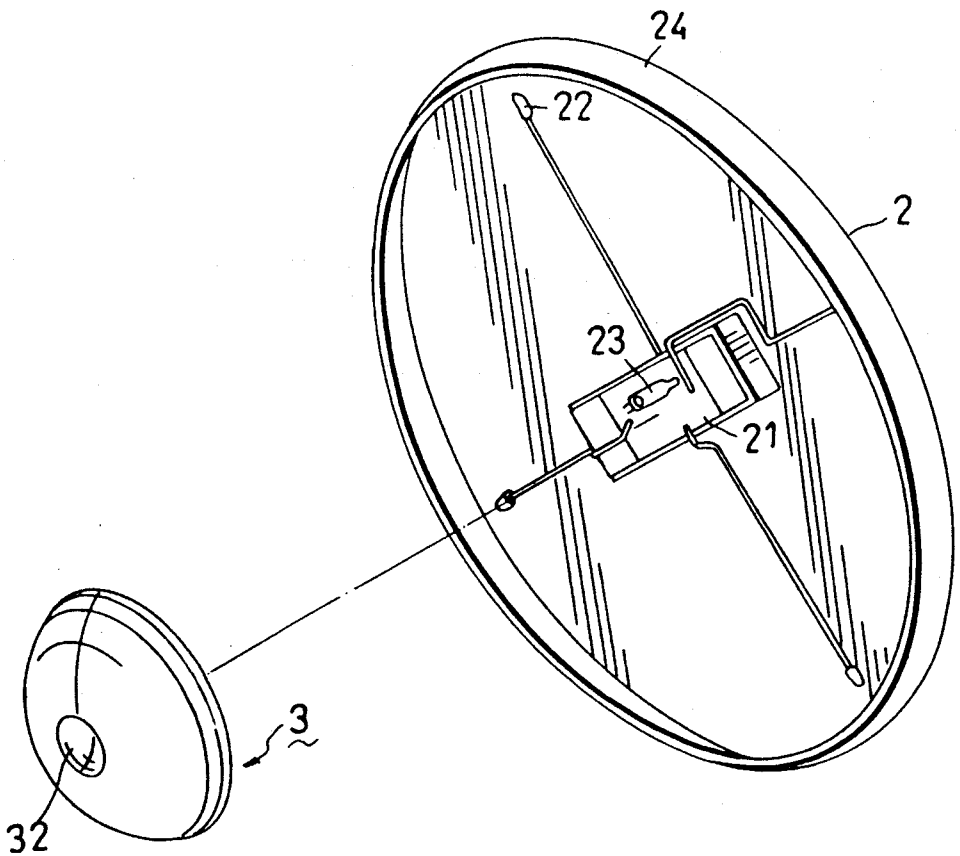
FIG. 3 is an exploded view of a flying disk of the present invention.

Referring to FIG. 3, the flying disk of the present invention is shown to comprise a circular plate (2), preferably made of a plastic material and having an upper surface, a lower surface and an annular flange (24) extending downward therefrom, a circuit board (21) with an eccentric switch (23) being provided on the lower surface of the circular plate (2) and a plurality of illuminating units (22) being provided on the upper surface of the circular plate and electrically connected to the circuit board (21). These are the same as in the conventional flying disk so that the flying disk will give out lights or multiple lights when in flight. A game can be played by throwing the flying disk.

Figure 4:
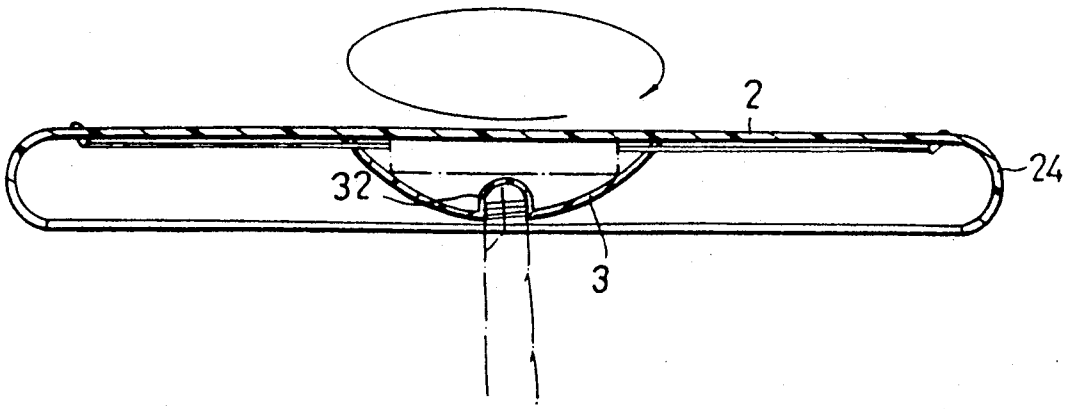
FIG. 4 shows the flying disk of the present invention in application.

A bowl-shaped member (3) which can be made from any suitable material is attached securely to the lower surface of the circular plate (2), encapsulating the circuit board (21). An important feature to note is that the bowl-shaped member (3) has a vertical length with respect to the circular plate (2) less than the vertical length of the annular flange (24) with respect to the circular plate (2). The lower portion of the bowl-shaped member (3) has a threaded recess (32) extending into the same. A finger can be inserted into the threaded recess (32) to balance the circular plate (2) while the circular plate is spun, as shown in FIG. 4. A spinning competition can be held between two rival persons.

Figure 5:
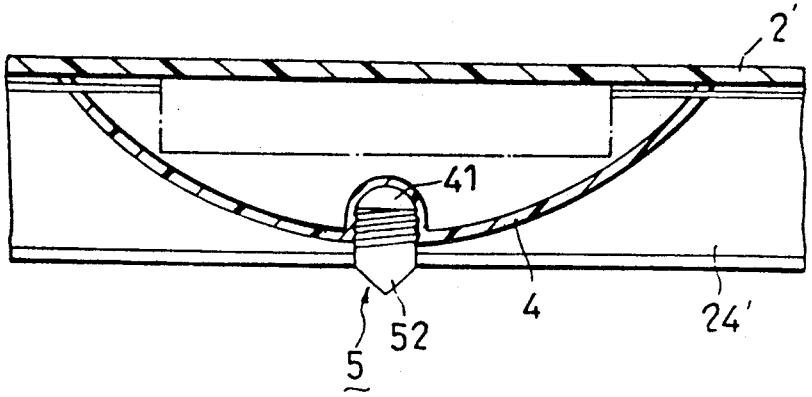
FIG. 5 shows the flying disk of the present invention in application in another way.

Referring to FIG. 5, an externally threaded rod (5) is threaded into the threaded recess (41) of the bowl-shaped member (4). In that situation, the tapered end (52) of the threaded rod (5) extends far beyond the annular flange (24') of the circular plate (2'), such that the whole assembly can be spun as a top. A distinct feature the conventional flying disk can not provide. A player needs to buy only a flying disk of the present invention, but he can play various kinds of games with that single flying disk. This is the most distinguishing feature of the present invention.

While a preferred embodiment has been illustrated and described, it will be apparent that many changes and modifications may be made in the general construction and arrangement of the present invention without departing from the spirit and scope thereof. Therefore, it is desired that the present invention be not limited to the exact disclosure but only to the extent of the appended claims.

I claim:

1. A flying disk including a circular plastic plate having an upper surface, a lower surface and an annular flange extending downward therefrom to a plane parallel to said circular plate, a circuit board being provided on said lower surface of said circular plate, a plurality of illuminating units being provided on said upper surface of said circular plate. and electrically connected to said circuit board, and a bowl-shaped member being attached to said lower surface of said circular plate, encapsulating said circuit board;

the improvement comprising: said bowl-shaped member having a vertical height with respect to said circular plate which is less than a vertical height of said annular flange with respect to said circular plate, said bowl-shaped member having a lower portion with a threaded recess which extends into said bowl-shaped member;

a short rod having a tapered end and another end of said short rod being threadable into said threaded recess, said rod having a length allowing said tapered end to extend below said plane when said short rod is threaded into said threaded recess; and whereby said short rod can be removed from said threaded recess, and a finger can be inserted into said threaded recess to balance said circular plate while said circular plate is rotated.

* * * * *